United States Patent [19]

Cheng

[11] 4,425,605

[45] Jan. 10, 1984

[54] DECORATIVE LIGHTING STRING FOR ASSEMBLY WITH OVERCURRENT PROTECTION

[76] Inventor: Sam Cheng, No. 11, Lane 207, Hsimen St., Hsin-Chu, Taiwan

[21] Appl. No.: 177,837

[22] Filed: Aug. 14, 1980

Related U.S. Application Data

[63] Continuation-in-part of Ser. No. 7,610, Jan. 29, 1979, abandoned.

[51] Int. Cl.[3] ..... F21M 1/00

[52] U.S. Cl. ..... 362/227; 315/185 s; 362/122; 362/123; 362/221; 362/225; 362/249; 362/252; 362/376; 362/806

[58] Field of Search ..... 315/185 S; 362/122, 362/123, 221, 225, 227, 249, 252, 376, 806

[56] References Cited

U.S. PATENT DOCUMENTS 3,968,398 7/1976 Lehmann ..... 362/806 X 4,223,248 9/1980 Tong ..... 315/185 S

*Primary Examiner*—Stephen J. Lechert, Jr.

*Attorney, Agent, or Firm*—McGlew and Tuttle

[57] ABSTRACT

A decorative lighting string set assembly comprising a plug, an overcurrent protective device and a plurality of bulbs in series or parallel connection, one terminal of the overcurrent protective device is connected to the plug with larger conductors and the other is connected to bulbs with smaller conductors for input of power. The overcurrent protective device may be a stationary or a replaceable structure.

6 Claims, 3 Drawing Figures

DECORATIVE LIGHTING STRING FOR ASSEMBLY WITH OVERCURRENT PROTECTION

The present application is a continuation-in-part of U.S. application Ser. No. 007,610 filed Jan. 29, 1979, now abandoned.

FIELD AND BACKGROUND OF THE INVENTION

The invention relates to a decorative lighting string set and more particularly to a decorative lighting string set with overcurrent protection wherein an overcurrent protective device is engaged between a plug and the string set. One terminal of the protective device is connected to the plug with larger conductors and the other is connected to the string set with smaller conductors.

Traditionally, a decorative string set is a series or parallel connection of bulbs and one end of the set is connected to power source in application. Consumers typically want to have conductors, which connect the bulbs, to be smaller to facilitate hanging and decoration. But in the view of safety, the larger conductors are superior since the larger conductors permit larger current without risk. The view points are contradictory.

Conductors connected in the conventional decorative lighting string set have the same diameter from the power connecting terminal to the last bulb. The diameter of the conductor is designed on electric safety basis. Therefore, it does not meet requirement of consumers.

SUMMARY OF THE INVENTION

It is therefore an object of the invention to provide a decorative lighting string set with an overcurrent protective device so that conductors for bulbs can be smaller and the protective device can be actuated to disconnect the string set from power sources in case of overload or short-circuit.

It is another object of the invention to provide an overcurrent protective device for decorative lighting string set which is connected between the plug and the string set, the protective device having two larger conductors at one terminal connected to the plug, and two smaller conductors at the other terminal for connecting the string set.

In accordance with the invention, an overcurrent protection device is provided, in combination with a decorative lighting string assembly of the type having a plug, a plurality of bulbs in a plurality of sockets, and conductor means for effectively interconnecting each of the bulbs in series or parallel, which includes a housing, means for disconnecting power flow through the string set responsive to an overload including a plurality of posts fixedly mounted within the housing, a first terminal in the housing, first conductor means for interconnecting the plug to the first terminal, a second terminal in the housing, second conductor means for interconnecting the second terminal to the plurality of bulbs and the bulbs to each other, each of the first conductor means and the second conductor means being winded around at least one of the posts, the first conductor means having a heavier wire gage than the second conductor means, and spring means for biasing the fuseable connecting element into connection with the first and second terminals.

It is a further object of the invention to provide an overcurrent protection device which is simple in design, rugged in construction and economical to manufacture.

For an understanding of the principles of the invention, reference is made to the following description of a typical embodiment thereof as illustrated in the accompanying drawings.

DESCRIPTION OF THE PREFERRED EMBODIMENTS

Figure 2B:
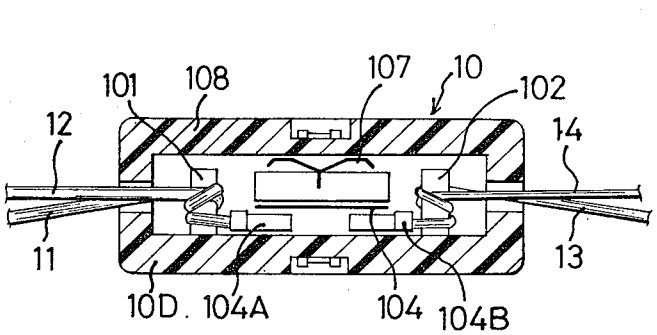
FIGS. 2A and 2B illustrate a top view and a side sectional view respectively of an embodiment of a stationary protective device for string set according to the invention.

Referring now to the drawings, wherein like reference numerals designate like or corresponding parts throughout the several views, a protective device 10 is interconnected between a plug 2 and a circuit connecting a plurality of bulbs $X_1$–$X_n$. Two conductors 11 and 12 are connected between a terminal of the plug 2 and one end of the device 10 and another two conductors 13 and 14 connect the other end of the device 1 to bulbs. The conductors 11 and 12 have a larger diameter, for example, having an AWG Gage No. 20, than the two conductors 13 and 14, which, for example, have an AWG Gage No. 24. The two smaller conductors 13 and 14 are connected with the string set in series or parallel electrical connection. The arrangement is electrically safe and hanging thereof may be conveniently effected.

Figure 2A:
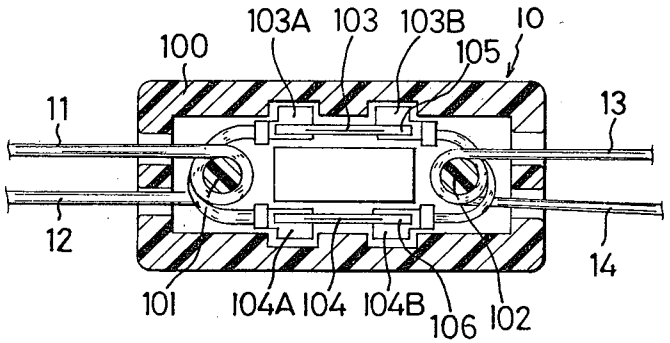

Referring now to FIGS. 2A and 2B, a stationary protection device 10 for a string set according to the invention is illustrated. As shown in the drawings, the protection device 10 is contained by a housing 100. Two fixed posts 101 and 102 are formed in the housing 100. Two fusible links or fusible protection elements 103 and 104 are connected respectively with terminals 103A, 103B and 104A at both ends. The said two elements 103, 104 are placed at opposite sides of the housing 100 respectively at a spaced distance from each other. Two larger conductors 11 and 12, connected to the plug 2, and two smaller conductors 13 and 14, connected to bulbs $X_1$–$X_n$, are wound around the fixed posts 101 and 102, respectively, prior to connecting terminals 103A, 104A and 103B, 104B to the larger conductors 11, 12 and the smaller conductors 13, 14, respectively. By means of restriction effect from the fixed posts 101 and 102, pulling of conductors 11, 12 and 13, 14 will not cause disconnection of the conductors from terminals 103A, 104A and 103B, 104B. The protection elements 103 and 104 are securely connected to the terminals 103A, 103B, 104A and 104B. Alternatively, the two fusible protection elements 103, 104 can be embodied respectively in two insulating elements 105 and 106 and biased by a spring means 107, or supported by any other appropriate means, so that they are securely affixed to the terminals. An upper housing portion 108 is fixed to the housing 100 with appropriate manner such as, rivets or adhesive (not shown) so that the housing 100 is tightly sealed. Then, a stationary protective device is completed and ready for use.

Figure 1:
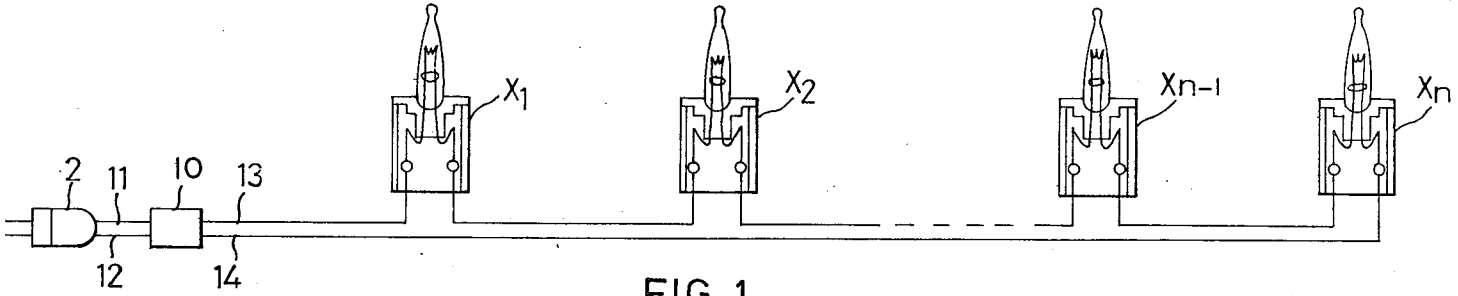
FIG. 1 is a schematic diagram showing connection of an embodiment of a string set assembly according to the invention.

The above-described stationary protective device 10 is especially suited for a series string set without parallel connection and an end connector 2 as shown in FIG. 1. Safety current in fusible protection elements 103 and 104 is equal to the functional current of the string set. If there is an overload in the string set, the fusible protection elements 103, 104 will be burnt (melted) and power is disconnected. The burnt protection element cannot be reset or renewed. The fusible links preferably are a copper alloy wire having a circulator cross-section with about 1.0 mm diameter or formed as a foil having a width of about 1.0 mm and thickness of about 0.25 mm.

Figure 3D:
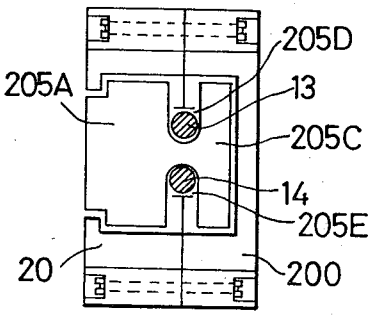
FIGS. 3A to 3D illustrate a top view, front view, left side view and right-side view respectively of an embodiment of a replaceable protective device for string set according to the invention.
Figure 3A:
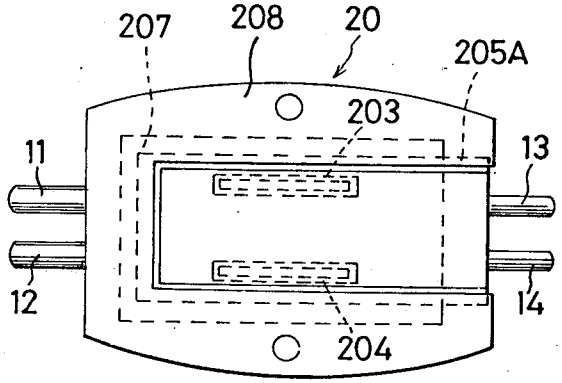
Figure 3B:
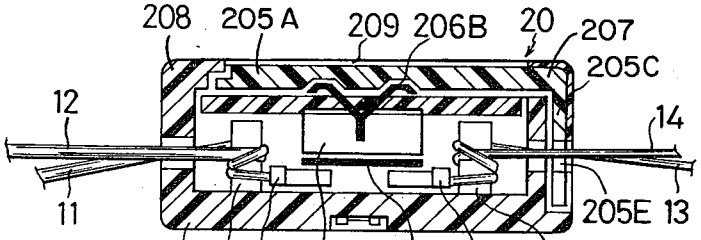
Figure 3C:
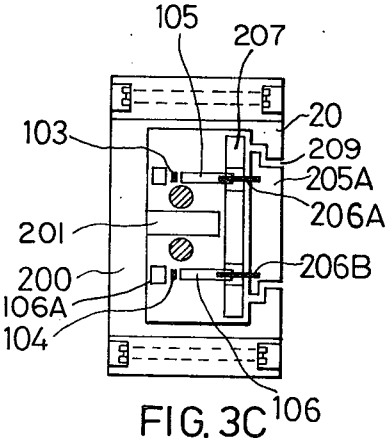

As shown in FIGS. 3A–3D, a replaceable protective device 20, as disclosed according to another embodiment of the invention, includes connection of protection elements 103 and 104, and connecting of conductors 11, 12, 13 and 14 substantially as shown in FIGS. 2A and 2B. An upper housing portion 208 is designed so as to facilitate the replacement of protection elements 103 and 104. In the structure, an insulative plate 207, with a face that has an cross-sectional area which is larger than an opening 209, provided at the top of the upper portion 208. When the upper housing portion 208 is engaged with the housing 200, the plate 207 will contact the internal surface of the portion 208 closely as described hereafter. Two slotted apertures 203, 204 are formed in the plate 207 for loading and unloading of the protection elements 103 and 104 with the insulating elements 105 and 106. The two apertures 203 and 204 are relatively small for the prevention of accession of foreign matters or fingers. After loading of the protection elements 103 and 104 with insulating elements 105 and 106, a movable cover 205A can be inserted into opening 209 in the portion 208. An appropriate spring means such as two spring elements 206A, 206B engage with the cover 205A tightly biasing the cover against the housing 200 through a projection (not shown) provided interally of the upper housing portion 208 and a recess (not shown) in the housing 200. The portion 208 and the housing 200 are closely connected by means of the combination of the said projection and the recess. The movable cover 205A, as shown in FIG. 3B, can be L-shaped. The L-shaped movable cover 205A, shown in FIG. 3B, has a longer horizontal leg portion disposed adjacent to the opening 209, provided at the top of the upper housing portion 208, and a vertical leg portion depending from one end of the horizontal leg portion. The shorter leg portion is provided with two openings 205D and 205E for passing conductor leads at an extended leg end 205C thereof.

The replaceable protection device of FIGS. 3A–3D is especially suitable for a string set having parallel circuits since current will vary with a different number of parallel paths. The protection elements can be quickly and easily changed according to the actual current. Breakdown of circuit which causes overload will break the protection elements 103 and 104. After the breakdown is cleared, new protection elements of the same specification can be replaced immediately.

From the foregoing description, it may be appreciated that the overcurrent protective device is connected between the plug and the string set, once the current in the string set is larger than rated value, the protection elements will be broken and power will be cut off for safety. Furthermore, the conductors connecting the plug are larger so that connecting or disconnecting of the plug to or from power source may apply a larger pulling force and then, the conductors will be more durable. The conductors connecting bulbs are smaller so as to be more convenient in hanging of string set. The invention can be applied in series circuit or parallel connection of two or more ways without using larger conductors such as AWG Gage No. 20.

It will, of course, be realized that various modifications can be made in the design and the structure of the decorative lighting string set assembly according to the invention without departing from the essential features and spirit thereof, it should be understood that within the scope of the appended claims the invention may be practiced otherwise than as specifically illustrated and described.

What is claimed is:

1. A decorative lighting string with overcurrent protection comprising:

a plug adapted for connection of a source of current;

a pair of large diameter conductors connected to said plug;

a protection device connected to said pair of larger diameter conductors;

a pair of small diameter conductors connected to said protection device;

a plurality of sockets connected in one of parallel and series to said pair of small diameter conductors; and a bulb connected in each of said sockets for receiving current through said pair of small diameter conductors;

said protection device comprising a housing defining a cavity having at least one opening on one side thereof for said large diameter conductors and at least one opening on an opposite side thereof for said small diameter conductors, a pair of spaced-apart posts extending into said cavity and adjacent each of said openings respectively, said large diameter conductors wrapped around one of said posts and said small diameter conductors wrapped about the other of said posts, a first contact connected in said cavity to each of said large diameter conductors and a second contact connected in said cavity to each of said small diameter conductors, a pair of fusible links connected in said cavity between each first contact and each second contact respectively.

2. A decorative lighting string according to claim 1, wherein said cavity is open on a top thereof and over said first and second contacts and said pair of posts, each of said fusible links connected to an insulating element, an insulative plate having a pair of apertures therein for receiving said insulating elements, said insulative plate covering a major portion of said cavity, an L-shaped cover slidably engaged with said housing and over said insulative plate, and a biasing spring connected between each of said insulating elements and said cover for biasing said fusible links against said contacts.

3. A decorative lighting string according to claim 2, wherein said L-shaped cover includes a long leg extending over said insulative plate and a short leg overlying one of said housing end openings, said cover short leg having an opening therein aligned with said one of said end openings for receiving one of said large and small diameter conductors, whereby said cover is slidable to expose said conductive plate and said insulating elements with each of said fusible links is removable from said housing cavity for replacement.

4. In combination with a decorative lighting string set assembly of the type having a plug, a plurality of bulbs in a plurality of sockets, and a conductor for effectively interrupting each of the bulbs in series or parallel, an overcurrent protection device comprising a housing, means for disconnecting power flow through the string set responsive to an overload including a plurality of fusible connecting elements mounted within the housing, a plurality of posts fixedly mounted within said housing, a first terminal in said housing, first conductor means for interconnecting said plug to said first terminal, a second terminal in said housing, second conductor means for interconnecting said second terminal to said plurality of bulbs and said bulbs to each other, each of said first conductor means and said second conductor means being winded around at least one of said posts, said first conductor means having a heavier wire gage than said second conductor means, and spring means for biasing said fusible connecting element into connection with said first and second terminals, said housing including an upper opening, an L-shaped cover member for covering said opening being removably mounted within said housing having a first leg portion adjacent said opening and a second leg portion depending from said first leg portion adjacent a side wall of said housing, an insulating plate member mounted intermediate said cover member and said posts, said plate having a face adjacent said opening having a cross-sectional area relatively larger than said opening disposed beneath said cover member, said insulating plate having a slotted aperture extending through said plate, said spring means including a spring engaged with said cover member and extending through said aperture.

5. The combination according to claim 4, wherein said spring means includes an insulating member supported by said spring.

6. The combination according to claim 5, wherein each of said fusible connecting elements is housed within said insulating member.

* * * * *